United States Patent [19]

Marsh

[11] Patent Number: 5,012,547

[45] Date of Patent: May 7, 1991

[54] APPARATUS FOR REMOVING FLUID PARTICLES FROM CONTAINERS

[75] Inventor: Ralph Z. Marsh, Golden, Colo.

[73] Assignee: Adolph Coors Company, Golden, Colo.

[21] Appl. No.: 441,551

[22] Filed: Nov. 27, 1989

[51] Int. Cl.[5] ..... B08B 5/02

[52] U.S. Cl. ..... 15/304; 15/306.1; 15/309.2; 15/316.1

[58] Field of Search ..... 15/304, 306.1, 309.2, 15/309.1, 316.1

[56] References Cited

U.S. PATENT DOCUMENTS

| | | | |
|---|---|---|---|
| 1,681,556 | 8/1928 | Parker | 15/309.2 |
| 1,689,757 | 10/1928 | Taylor | 15/309.2 X |
| 2,073,746 | 3/1937 | Keller | 15/304 |
| 2,255,615 | 9/1941 | Frankel | 15/304 |
| 2,501,367 | 3/1950 | Wehmiller et al. | 15/309.2 |
| 2,665,697 | 1/1954 | Hohl et al. | 15/304 X |
| 2,917,768 | 12/1959 | Walberer | 15/304 |
| 2,935,034 | 5/1960 | Jacobs | 15/309.2 X |
| 3,574,261 | 4/1971 | Bailey | 15/309.1 X |
| 3,983,597 | 10/1976 | Neumann | 15/304 |
| 4,010,514 | 3/1977 | Fischer et al. | 15/309.1 |

*Primary Examiner*—Chris K. Moore
*Attorney, Agent, or Firm*—Klaas & Law

[57] ABSTRACT

The invention is directed to a system for removing fluid particles retained on containers, each having an open end and a closed end, after they exit from a washing operation wherein the containers are transferred from the washing operation to a drying operation with the open ends thereof facing in a downward direction and wherein the fluid particles are removed from the containers as they are transferred from the washing operation to the drying operation by passing air at relatively high velocities over at least the portion of the containers next adjacent to the open ends thereof wherein the flow of the high velocity air is generated by a vacuum source.

17 Claims, 3 Drawing Sheets

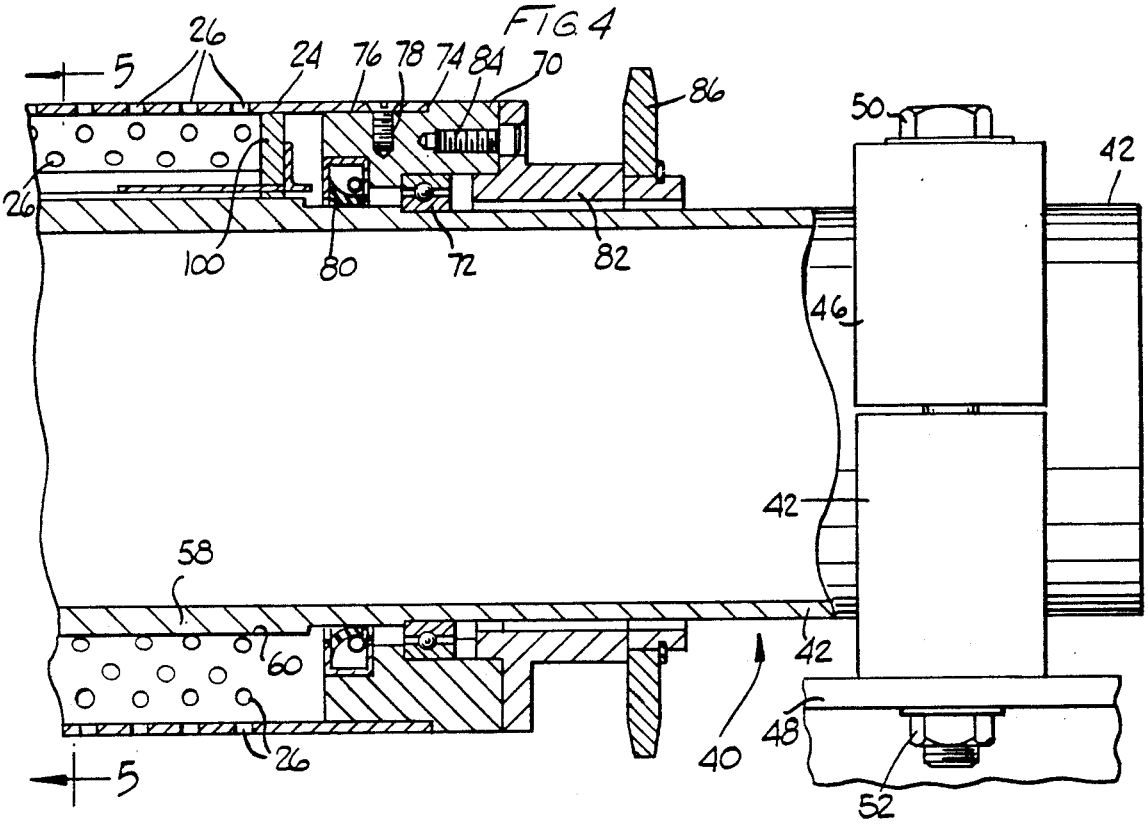
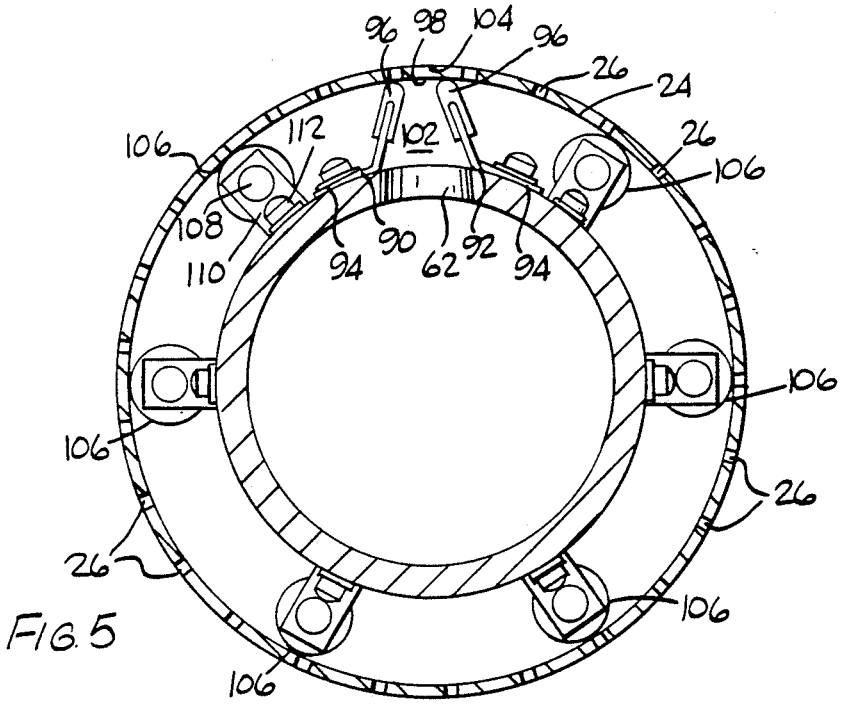
FIG. 5

APPARATUS FOR REMOVING FLUID PARTICLES FROM CONTAINERS

FIELD OF THE INVENTION

This invention relates generally to apparatus for use in the manufacture of containers, such as aluminum, steel and plastic cans or bottles, and more specifically to the removal of fluids retained on a container after a washing operation.

BACKGROUND OF THE INVENTION

During the manufacture of containers, such as aluminum, steel and plastic cans or bottles, it is necessary to apply lubricating materials to facilitate various manufacturing operations. Before the final processing steps and the filling of the containers with a beverage, it is necessary to wash the containers and then to dry them. After the containers have been washed, they are moved into a drying oven so as to remove any fluid particles that are retained thereon. It has been the general practice to use only the thermal energy and forced convection in the drying oven to remove the fluid particles on the containers after the washing operation.

BRIEF DESCRIPTION OF THE INVENTION

This invention provides apparatus for removing fluid particles retained on a container, such as cans or bottles, after a washing operation by moving air at relatively high velocities over at least the portions of the container next adjacent to the open ends thereof and wherein the movement of the air is generated by a vacuum source.

In a preferred embodiment of the invention, the apparatus for removing fluid particles retained on a container after a washing operation comprises a fixed support frame located on a surface of a building. A first moving conveyor is mounted on the support frame and carries containers, such as aluminum cans, through the washing operation. The containers have an open end and a closed end and have their open ends in contact with the first moving conveyor. A second moving conveyor is mounted on the support frame and carries the containers through a drying operation. The open ends are in contact with the second moving conveyor. The first and second moving conveyors are fluid pervious so that fluids may pass readily therethrough. Moving means, such as a vacuum conveyor, move the containers with their open ends facing in a downward direction from the first moving conveyor to the second moving conveyor. During the movement of the conveyors from the first moving conveyor to the second moving conveyor, fluid particles retained on the containers after the washing operation are removed by passing air at relatively high velocities over at least the portions of the container immediately adjacent to the open ends thereof. The movement of the air is induced by a vacuum source located a minimum distance below the open ends at at least one location between the first moving conveyor and the second moving conveyor. A rotating roller moves over the vacuum source and moves in the same direction and at substantially the same velocity as the moving means. The top of the rotating roller is spaced a distance less than about 0.099 inch from the open ends of the containers.

BRIEF DESCRIPTION OF THE DRAWINGS

An illustrative and presently preferred embodiment of the invention is shown in the accompanying drawings in which:

FIG. 4 is a partial side elevational view taken from the left side of FIG. 1;

FIG. 5 is a cross-sectional view taken on the line 5—5 of FIG. 4;

DETAILED DESCRIPTION OF THE INVENTION

Figure 1:
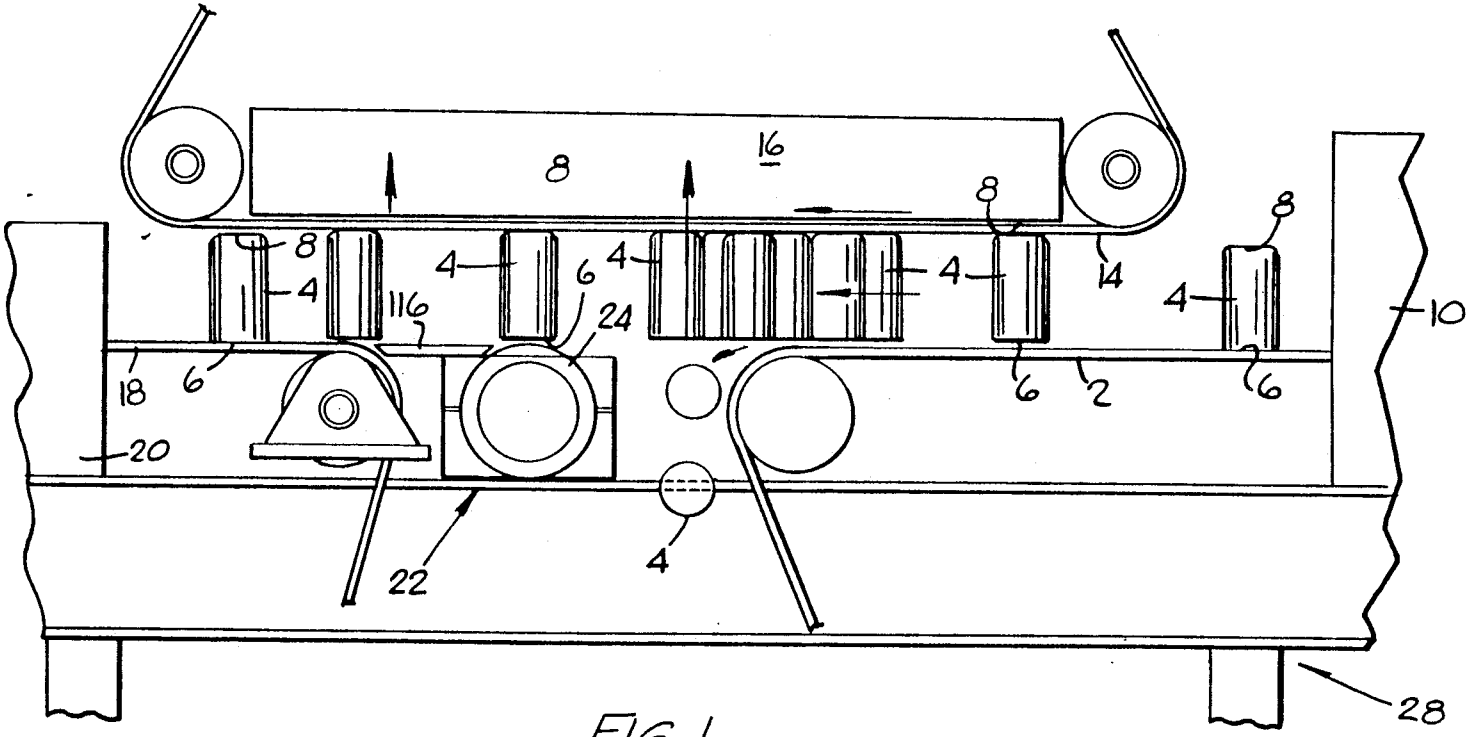
FIG. 1 is a partial front elevational view of a preferred embodiment of the invention.

A preferred embodiment of the invention is illustrated in FIG. 1 and comprises a first moving conveyor 2 having a plurality of containers 4 supported thereon for movement therewith. The first moving conveyor has an effective container carrying width of about 67 inches and normally carries containers at the rate of between about 2,700 to 3,000 per minute. Each container 4 has an open end 6 and a closed end 8. The open end 6 is in contact with the first moving conveyor 2. The first moving conveyor 2 carries the containers 4 through a washing operation 10. When the containers 4 leave the washing operation, they have fluid particles 12, such as water, retained thereon. The containers 4 move beneath a moving transfer conveyor 14, having the same width and capabilities as the first moving conveyor 2, which, in the preferred embodiment is a perforated belt, and passes beneath a vacuum box 16 which pulls the closed ends 8 of the container into contact with the moving transfer conveyor 14 for movement therewith. Any container 4 that is not in an upright position falls off the end of the first moving conveyor 2. The moving transfer conveyor 14 moves the containers 4 from the first moving conveyor 2 to a second moving conveyor 18, having the same width and capabilities as the first moving conveyor 2, on which the containers 2 are supported with their open ends 6 in contact with the second moving conveyor 18 through a drying operation 20. The first and second moving conveyors 2 and 18 are each open flat wire mesh belts which is seventy-eight percent open. Apparatus 22 for removing the fluid particles 12 from the container 4 is located between the first and second moving conveyors 2 and 18 and comprises a perforated rotating roller 24 moving over a vacuum source, described below, to generate a flow of air at relatively high velocities moving over the portions of the containers 4 immediately adjacent to the open ends 6 thereof to remove the particles 12. The perforations 26, FIG. 4, have a diameter of 0.125 inch and are spaced apart on 0.245 centers in an equilateral design. The perforated rotating roller 24 moves in the same direction and at substantially the same velocity as the moving transfer conveyor 14. All of the foregoing structures are supported on a support frame 28 mounted on a floor of a building.

Figure 3:
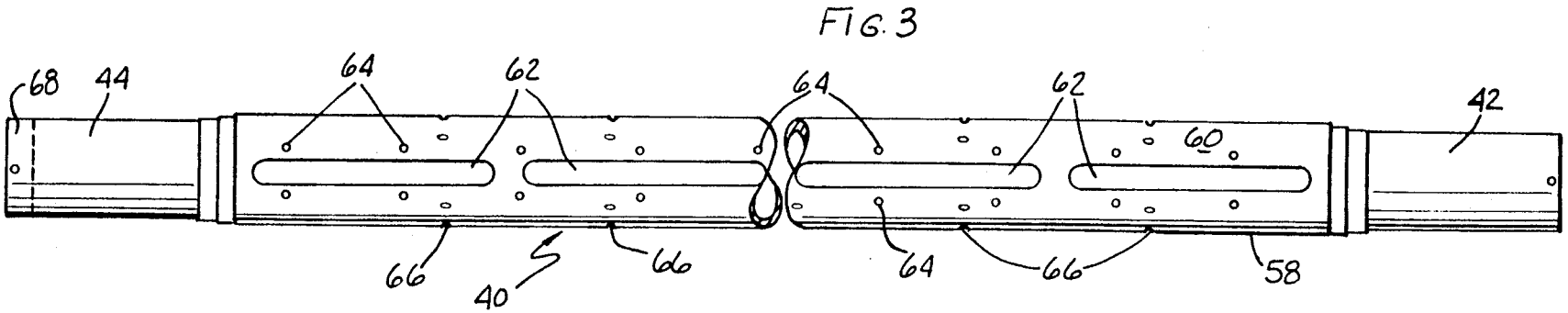
FIG. 3 is a top plan view of the support pipe.
Figure 2:
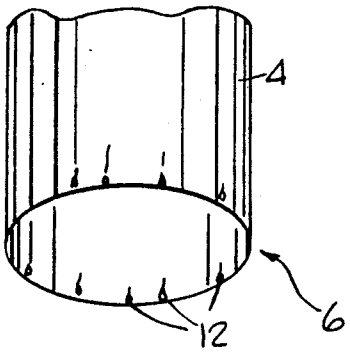
FIG. 2 is a perspective view of the open end of a container.
Figure 6:
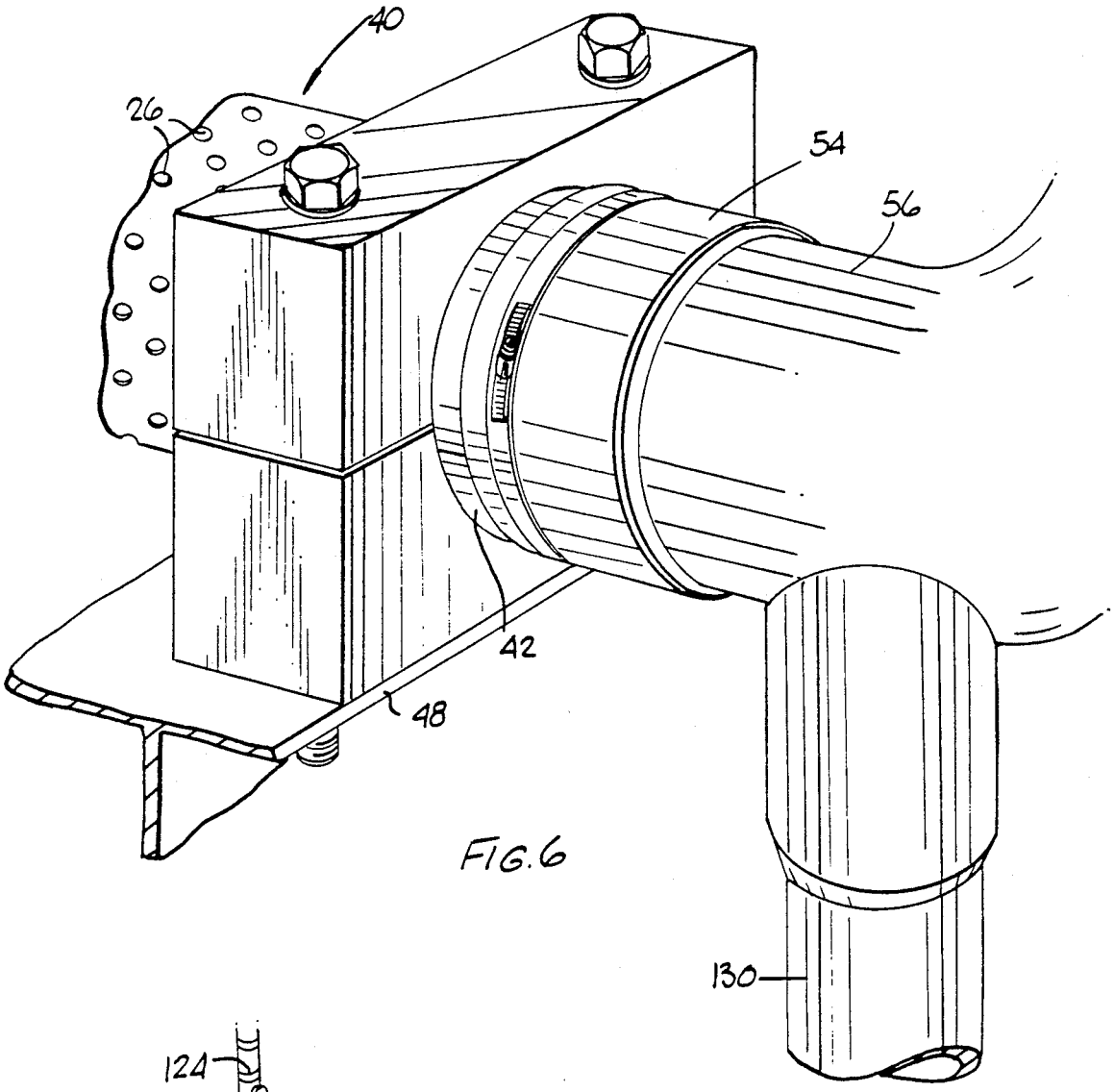
FIG. 6 is a perspective view of the vacuum connection and drain.

The vacuum source is illustrated in FIGS. 3—5 and comprises a hollow support pipe 40 having opposite end portions 42 and 44 which are mounted by split mounting plates 46 on a flange portion 48 of the support frame 28 by bolts 50 and nuts 52. The end portion 42 is connected by connecting sleeve 54, FIGS. 6 and 7, to a pipe 56 which is connected to a vacuum creating means (described below). The hollow support pipe 40 has a central body portion 58 having a generally cylindrical outer surface 60. A plurality of spaced apart, longitudinally extending, elongated slots 62 extend through the sidewall of the hollow support pipe 40 and are in axial alignment. The hollow support pipe 40 has a first plurality of threaded openings 64 and a second plurality of threaded openings 66 for purposes described below.

As illustrated in FIGS. 4 and 5, the perforated rotating roller 24 is mounted for rotation on the hollow support pipe 40. An annular member 70 is mounted for rotation on a bearing 72, which is fixedly mounted on the hollow support pipe 40. An annular recess 74 is formed in the annular member 70 for receiving the end portion 76 of the perforated rotating roll 24. The end portion 76 is secured to the annular member 70 by threaded bolts 78. Sealing means 80 are secured to the annular member 70 to form a seal between the annular member 70 and the hollow support pipe 40. An annular sprocket support 82 is secured on the annular member 70 by threaded bolts 84 and has a sprocket 86 secured thereon, which sprocket 86 is rotated by a drive chain (not shown) to rotate the perforated rotating roller 24.

A pair of elongated angle brackets 90 and 92 are mounted by threaded bolts 94 threaded into threaded openings 64 and are located on each side of the slots 62. Sealing strips 96 are mounted on the angle brackets 90 and 92 and are in contact with the inner surface 98 of the perforated rotating roller 24. End seals 100 are mounted on the central body portion 58 and are in contact with sealing strips 96 and angle brackets 90 and 92 to form a passageway leading to the elongated slots 62 so as to form a vacuum source 102 for the perforated rotating roller 24. The perforated rotating roller 24 is mounted so that the outer peripheral surface 104 thereof is a minimum distance below the open ends 6 of the containers 4 as they pass over the vacuum source 102 which minimum distance is less than about 0.099 inch and preferably less than about 0.0630 inch.

A plurality of rotatable rolls 106 are mounted on shafts 108 mounted in angle brackets 110 secured to the central body portion 58 by threaded bolts 112 threaded into threaded openings 66. The rolls 106 are in contact with and are rotated by the perforated rotating roller 24 and provide support therefor. Each roll 106 has an axial length of about 6.625 inches and there are four sets of six rolls in each set. A plug 68 seals off the end portion 44.

Figure 7:
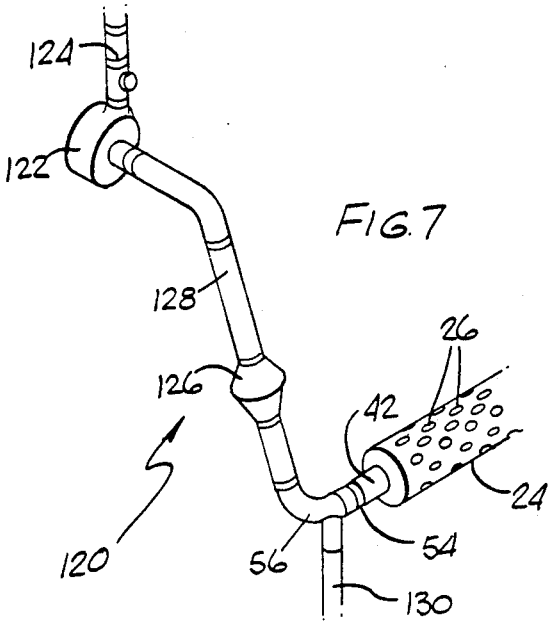
FIG. 7 is a schematic illustration of the vacuum creating apparatus.

In FIG. 7, there is a schematic illustration of the vacuum creating apparatus 120 which comprises a blower 122 mounted at a fixed location and having an exhaust duct 124 connected thereto. The blower 122 is connected to a filter 126 by piping 128. The pipe 56 connects the filter 126 to the end portion 42 of the hollow support pipe 40. A drain pipe 130 is connected to the pipe 56 and functions to remove the fluid particles 12 which have been removed from the containers 4. A conventional trap (not shown) is provided in the drain pipe 130 so that the vacuum forming apparatus 120 is not effected thereby.

The operation of the apparatus is illustrated in FIG. 1. As the containers 4 leave the washing operation 10 with the fluid particles 12 retained thereon, they are transferred to the moving transfer conveyor 14 by the vacuum in the vacuum box 16 and move with the moving transfer conveyor 14 with the open ends thereof facing in a downward direction. The fluid particles 12 generally migrate to the edges of the open ends 6 of the containers 4. As the containers 4 pass over the vacuum source 102, air moving at relatively high velocities removes the fluid particles 12 which then flow with the air through the hollow support pipe 40. The removed fluid particles 12 drop downwardly through the drain pipe 130. A threshold plate 116 extends between the perforated rotating roller 24 and the second moving conveyor 18. Each elongated slot 62 has an axial extent of about 10 inches and an arcuate extent of about 1.0 inch and the elongated slots 62 are spaced apart to provide a total axial extent of about 67 inches. The central body portion 58 has an external diameter of about 4.50 inches and a wall thickness of about 0.1875 inch. The perforated rotating roller 24 has an external diameter of about 6.438 inches and a wall thickness of about 0.062 inch so that the distance between the outer surface of the hollow support pipe 40 and the inner surface 98 is about 0.907 inch. The vacuum source 102 is equal to about 15 inches of water.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for removing fluid particles from containers comprising:

a support frame mounted at a fixed location;

a first moving conveyor mounted on said support frame and having a plurality of containers supported thereon, wherein said containers are exiting from a washing operation and have fluid particles retained thereon;

said containers having an open end and a closed end and said open ends are in contact with said first moving conveyor;

a second moving conveyor mounted on said support frame and having a plurality of containers supported thereon for moving said containers through a processing operation wherein said open ends of said containers are in contact with said second moving conveyor;

moving means mounted on said support frame for moving containers from said first moving conveyor to said second moving conveyor; and at least one fluid removing means mounted on said support frame for removing at least a portion of said fluid particles retained on said containers during said movement of said containers from said first moving conveyor to said second moving conveyor.

2. The invention as in claim 1 wherein said at least one fluid removing means comprises:

generating means for generating a flow of air at relatively high velocities over at least the portions of said containers next adjacent to said open ends.

3. The invention as in claim 2 wherein:

said generating means comprises a vacuum source.

4. The invention as in claim 3 wherein said moving means comprises:

a moving transfer conveyor having said closed ends of said containers in contact therewith.

5. The invention as in claim 4 and further comprising:

a perforated member having at least a portion thereof located between said vacuum source and said open ends of said containers and moving over said vacuum source in the same direction and at substantially the same velocity as said moving transfer conveyor.

6. The invention as in claim 5 and further comprising:

a member located between said perforated member and said second moving conveyor and having a generally planar upper surface; and said second moving conveyor having a generally planar upper surface lying in the same plane as said generally planar surface of said member.

7. The invention as in claim 5 wherein:

said first moving conveyor, said second moving conveyor, said moving transfer conveyor, said vacuum source and said perforated member have a linear extent of at least about four feet.

8. The invention as in claim 1 wherein said at least one fluid removing means comprises:

a vacuum source located between said first and second moving conveyors and immediately below said open ends of said containers as they move on said moving means for causing a flow of air over at least the portions of said containers next adjacent to said open ends.

9. The invention as in claim 8 and further comprising:

an elongated, hollow, perforated, rotating roller having generally cylindrical outer and inner peripheral surfaces;

said vacuum source being located within the periphery of said rotating roller and next adjacent to said inner peripheral surface; and said outer peripheral surface being located closest to said open ends of said containers as it passes over said vacuum source.

10. The invention as in claim 9 wherein:

said moving means comprising a moving vacuum conveyor having said closed ends of said containers in contact therewith; and said elongated, hollow, perforated, rotating roller moving in the same direction and at substantially the same velocity as said moving vacuum conveyor.

11. The invention as in claim 10 wherein said vacuum creating means comprise:

an elongated, hollow, support pipe having a peripheral sidewall having generally cylindrical outer and inner surfaces and extending between spaced apart portions of said support means and fixedly mounted thereon;

said elongated, hollow support pipe having a longitudinal axis;

plug means for closing one end of said hollow support pipe;

a vacuum creating apparatus;

connecting means for connecting the other end of said hollow support pipe to said vacuum creating apparatus;

at least one elongated slot having at least a pair of axially extending parallel sides extending through said sidewall;

mounting means for rotatably mounting said elongated, hollow, perforated roller on said support pipe; and drive means for rotating said elongated, hollow, perforated rotating roller.

12. The invention as in claim 11 wherein said at least one elongated slot comprises:

a plurality of elongated slots in axial alignment.

13. The invention as in claim 12 and further comprising:

nozzle forming means forming a passageway between said plurality of slots and said inner peripheral surface of said elongated, hollow, perforated rotating roller.

14. The invention as in claim 13 and further comprising:

a plurality of rolls mounted on said outer surface of said elongated, hollow support pipe for rotation relative thereto; and each of said rolls having a generally cylindrical outer peripheral surface located to be in contact with said inner peripheral surface of said elongated, hollow, perforated rotating roller to be rotated thereby.

15. The invention as in claim 14 wherein said processing operation comprises:

an oven for drying said containers.

16. Apparatus for removing fluid particles from containers comprising:

a support frame mounted at a fixed location;

a first moving fluid pervious conveyor mounted on said support frame for moving containers, each having an open end and a closed end, through a washing operation wherein said containers are moved with said open ends facing in a downward direction and having fluid particles retained thereon after passing through said washing operation;

a second fluid pervious conveyor mounted on said support frame for moving said containers through a drying operation with said open ends facing in a downward direction;

moving transfer means mounted on said support frame for transferring said containers from said first moving conveyor to said second moving conveyor with said open ends facing in a downward direction; and at least one fluid removing means mounted on said support frame for removing at least a portion of said fluid particles retained on said containers during said movement of said containers from said first fluid pervious moving conveyor to said second moving fluid pervious conveyor.

17. The invention as in claim 16 wherein said at least one fluid removing means comprises:

generating means for generating a flow of air at relatively high velocities over at least the portions of said containers next adjacent to said open ends.

* * * * *